US007069866B2

(12) United States Patent
Uppstu

(10) Patent No.: US 7,069,866 B2
(45) Date of Patent: Jul. 4, 2006

(54) SYSTEM FOR CONTROLLING THE FLOW PATTERN OF A RECOVERY BOILER

(75) Inventor: Erik Uppstu, Siivikkala (FI)

(73) Assignee: Oy Polyrec AB, Silvikkala (FI)

( * ) Notice: Subject to any disclaimer, the term of this patent is extended or adjusted under 35 U.S.C. 154(b) by 0 days.

(21) Appl. No.: 10/495,528

(22) PCT Filed: Nov. 5, 2002

(86) PCT No.: PCT/FI02/00862

§ 371 (c)(1),
(2), (4) Date: Oct. 27, 2004

(87) PCT Pub. No.: WO03/042452

PCT Pub. Date: May 22, 2003

(65) Prior Publication Data

US 2005/0061217 A1 Mar. 24, 2005

(30) Foreign Application Priority Data

Nov. 14, 2001 (FI) ..... 20012207

(51) Int. Cl.
*F23G 7/04* (2006.01)
*F23L 1/00* (2006.01)

(52) U.S. Cl. ..... 110/238; 110/297; 110/348

(58) Field of Classification Search ..... 110/348, 110/238, 342, 345, 347, 150, 157, 297, 314
See application file for complete search history.

(56) References Cited

U.S. PATENT DOCUMENTS

| | | | | |
|---|---|---|---|---|
| 4,940,004 | A * | 7/1990 | Jansen | 110/182.5 |
| 5,007,354 | A | 4/1991 | Uppstu | |
| 5,715,762 | A * | 2/1998 | Reilly | 110/165 R |
| 5,724,895 | A | 3/1998 | Uppstu | |
| 5,771,817 | A | 6/1998 | Olausson et al. | |

* cited by examiner

*Primary Examiner*—Kenneth Rinehart
(74) *Attorney, Agent, or Firm*—Browdy and Neimark, PLLC

(57) ABSTRACT

The invention relates to a system for controlling the flow field in a soda recovery boiler, said soda recovery boiler comprising at least a furnace (1), primary air ports (4) in the lower part of the furnace, so-called secondary combustion air ports (5) disposed above these, black liquor spray nozzles (6) placed similiarly above these and combustion air ports (5*b*) disposed above the black liquor spray nozzles (6). According to the invention, the soda recovery boiler is provided with substantially thin jets (7, 7*a*, 7*b*) supplying energy into the flow field and having a jet pressure in the nozzle equal to at least twice the jet pressure in the combustion air ports (5, 5*b*).

10 Claims, 4 Drawing Sheets

SYSTEM FOR CONTROLLING THE FLOW PATTERN OF A RECOVERY BOILER

Figure 1:
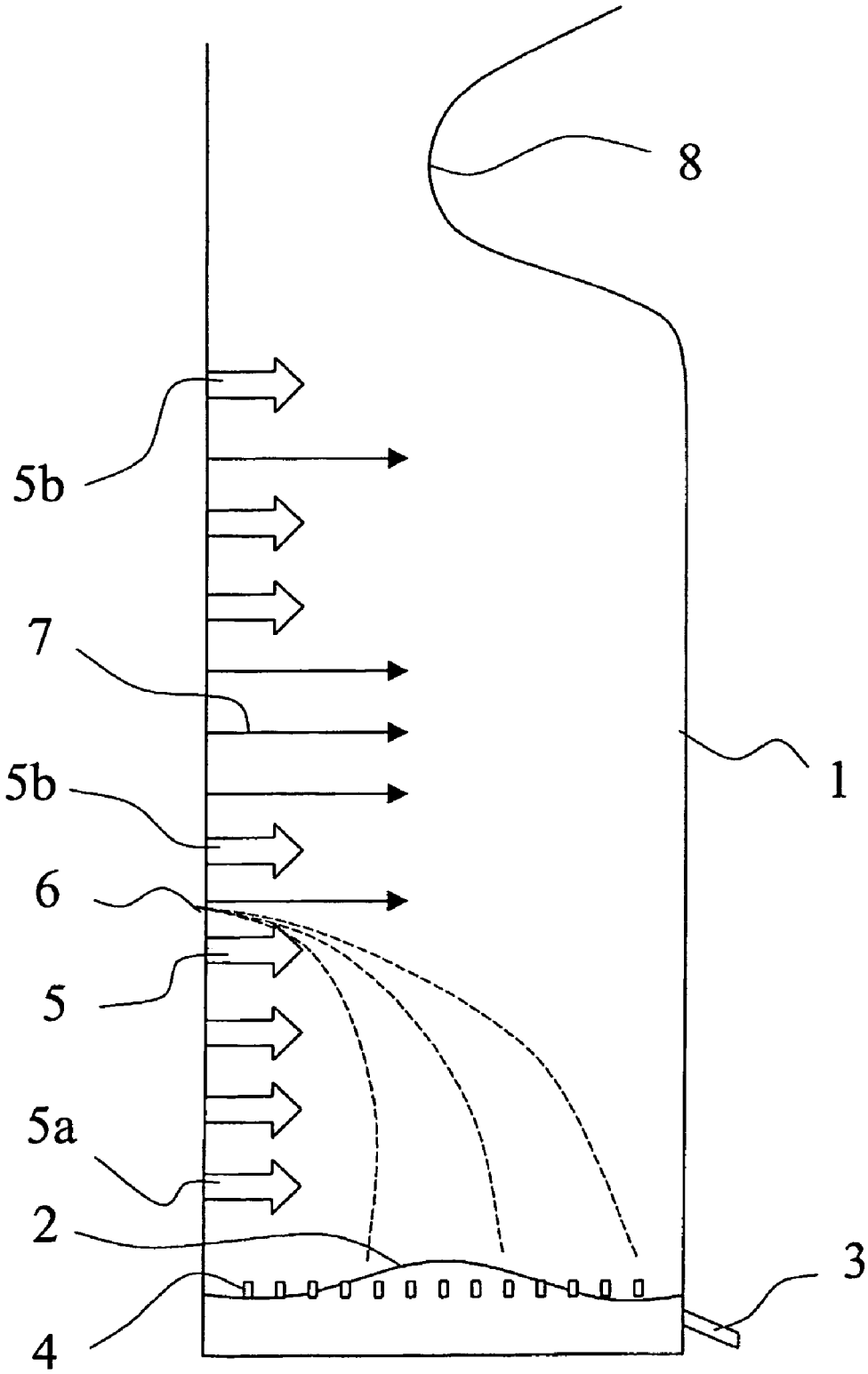

The present invention relates to a system as defined in the preamble of claim 1 for controlling the flow field in a soda recovery boiler The main function of a recovery boiler, or so-called soda boiler, is to process the spent liquor produced in the manufacturing processes in chemical pulp industry which mainly consists of black liquor, so as to allow the pulping chemicals, sodium and sulfur, contained in it to be recovered for reuse. The sulfur has to be reduced to sodium sulfide and the rest of the sodium has to be removed from the boiler in the form of carbonate. In traditional recovery boilers, the problem is that the internal flow field in the boiler is difficult to control so as to achieve optimal boiler operation and minimal emissions. Especially in the parts below the black liquor supply ports, the flows of combustion air converge in the corner areas of the boiler, flowing towards the center of the furnace and merging in the center and thus forming an intensive vertical flow in the upward direction. This flow distorts the flow field and causes a portion of the black liquor supplied in the form of drops to rise into the upper part of the furnace and into the superheaters and other heat recovery devices above it. The black liquor drops that have drifted up thus remain even completely unburned or are burned out in the wrong area with respect to optimal boiler operation. Consequently, the temperature in the upper part of the boiler is too high while in its lower part the temperature is correspondingly lower than optimal because the combustion does not occur entirely in the lower part. This means a decisive deterioration of the performance of the boiler. Thus, the distorted flow field leads to fouling, blockages and corrosion in the heat recovery equipment after the boiler, and the elements escaping too far up are a source of excessive sulfur, $NO_x$ and other emissions.

Various attempts to solve the problems have been made, especially by using different adjustments of the so-called secondary air supply. The air supply ports of a soda recovery boiler are usually provided with dampers, by means of which the pressure and velocity of flow of supply air can be adjusted within certain limits. However, this adjustment is not able in all load situations to guarantee sufficient air jet penetration for the required smooth flow field to be set up. Especially during operation with full load, all the combustion air ports have to be open, which means that their adjustment capacity has been used up. Moreover, the ports can not be throttled very much at the pressures available in prior-art systems because a small air flow is not sufficient to cool down the air port as required, as a result of which both the port and the damper may be burned in the great heat. A further drawback is that a small air flow produced with a low pressure is not able to properly penetrate into the furnace. In this case, it has an effect resembling in the first place the effect of the detrimental "false air".

Previously known is e.g. a combustion air supply arrangement as disclosed in Finnish patent no. 85187 (corresponding to U.S. Pat. No. 5,007,354). In this arrangement, the disposition and directional orientation of the combustion air supply ports are used as means of controlling the flow field. Some improvement to earlier boiler solutions has been achieved, but the arrangement still involves the drawback that no optimal flow field is set up, among other things because the combustion air jets disposed one above the other are directed in different directions.

Another Finnish patent, no. 101420 (corresponding to U.S. Pat. No. 5,724,895), also discloses a combustion air supply arrangement for a recovery boiler. In this solution, some deficiencies of the supply arrangement described in the above-mentioned earlier patent are improved and the flow field is brought under control by the use of a plurality of combustion air supply ports disposed in the same vertical rows. However, a problem in this solution is the scarcity of space in practical applications, especially when installed in old boilers. Another problem is the high price resulting from the numerous large supply ports, Yet another prior-art solution is that disclosed in Finnish patent no. 87246 (corresponding to U.S. Pat. No. 5,022,331), where secondary air is supplied into the boiler furnace through air ports of different sizes such that ports of a larger area are provided at the same horizontal level in the center part of the wall than in the parts closer to the corners of the wall. This arrangement is designed to ensure a constant combustion air penetration and to achieve an air supply as good and smooth as possible, covering the entire cross-sectional area of the boiler. The combustion air flow is adjusted by varying the hydraulic diameter of the air ports by means of dampers, and the pressure is adjusted by varying the pressure of combustion air in the air chamber. However, a drawback with this solution is a complicated and expensive structure requiring considerable space due to the large number and size of air ports. Although pressure control is used to adjust the supply air flow, the range of adjustment is small because the air chamber used in this solution is inadequate for producing high pressures.

In all known solutions, including the above-mentioned patents, the principle is to control the flow field using substantially low-pressure jets that carry a large amount of combustion air containing oxygen. Thus, large amounts of air are used with supply pressures of 2–50 mbar. The supply pressure in the primary ports, which are generally located lowest, is about 1–10 mbar, the pressure in the secondary ports placed in the middle area in the vertical direction is somewhat higher, i.e. about 20–30 mbar, while the supply pressure in the tertiary ports located highest is a little higher still, i.e. about 40–50 mbar. This means that the flow rates are not high, so it is necessary to supply plenty of air from large combustion air ports in order that the flow field can be controlled. This is expressly stated, among other things, in the last-described Finnish patent specification, in which the air ports in the middle part of the wall are larger than those at the edges.

A further problem is that the need for combustion air in the combustion process is not necessarily as regular as would be required for the flow field to be maintained. In some regions more air is needed, while in other regions less air is sufficient. It is unnecessary and even disadvantageous for the process to supply large amounts of combustion air into regions where no combustion air is needed but where the flow field would need energy, only to assist the flow field. Often, however, compromises are inevitably made, and therefore combustion air is supplied to where it is not needed. Similarly, insufficient air is available in regions where combustion air would be needed. As a consequence, the process does not yield an optimal result.

The object of the invention is to eliminate the above-mentioned drawbacks and to achieve an economical, space-saving and reliable system for controlling the flow field in a recovery boiler. A further object of the invention is to achieve good mixing of combustion air and black liquor in the flow field by using high pressure jets and thus, via good flow field control, to improve the capacity and other boiler performance values, among which emissions are particularly important. The system of the invention is characterized by what is presented in the characterization part of claim 1. Other embodiments of the invention are characterized by what is presented in the other claims.

In the solution of the invention, ports especially for combustion air are provided where combustion air is needed. Correspondingly, ports of small diameter for supplying kinetic energy at high pressure are provided where energy is needed for the control of the flow field but where combustion air is not necessarily needed. The solution of the invention has the advantage that the combustion process can be held better under control than before and the boiler is not supplied with unnecessary combustion air that would impair its performance. A further advantage is the economical price of the equipment as compared to prior-art solutions, in which the ports used are large and require large air channels and plenty of space. In the solution of the invention, the ports supplying energy to the flow field have a small cross-sectional area, even 100–200 times smaller than the largest prior-art air ports, and over 10 times smaller than even the smallest prior-art combustion air ports. This feature also allows the solution of the invention to be easily installed in old boilers when they are renewed. The small components and hoses are easy to fit in the narrow structures of old boilers. In addition, small components are economical in price. A further advantage is that, as the flow volumes are small, it is possible in the solution of the invention to use other pressure mediums besides air. For example, many plants have extra back-pressure steam, which is well applicable for this purpose. Yet another advantage is that, as high pressures and flow rates are used, the nozzles are well kept clean. Likewise, due to the higher flow rates, smaller ports can supply as much or even more energy for flow field control than large ports with low flow rates.

Figure 3:
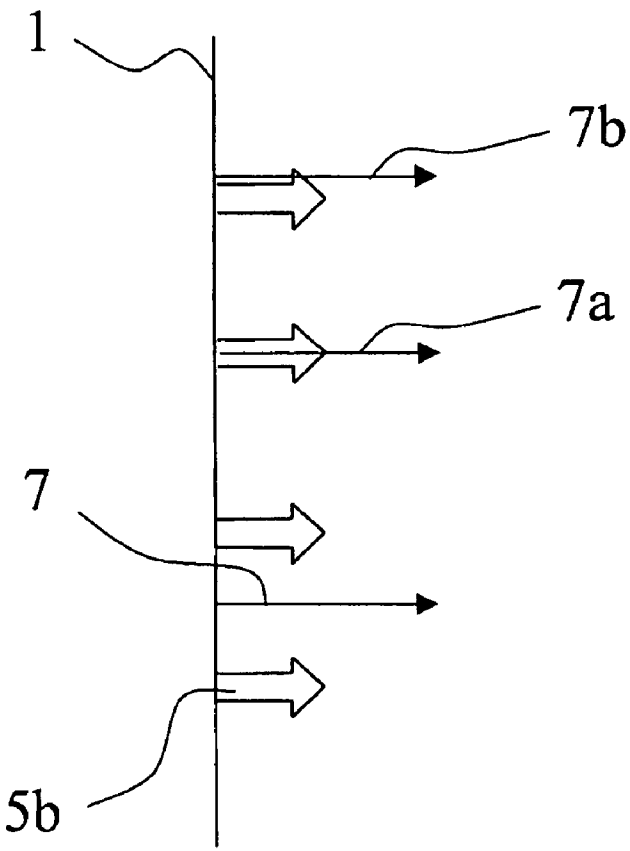
Figure 2:
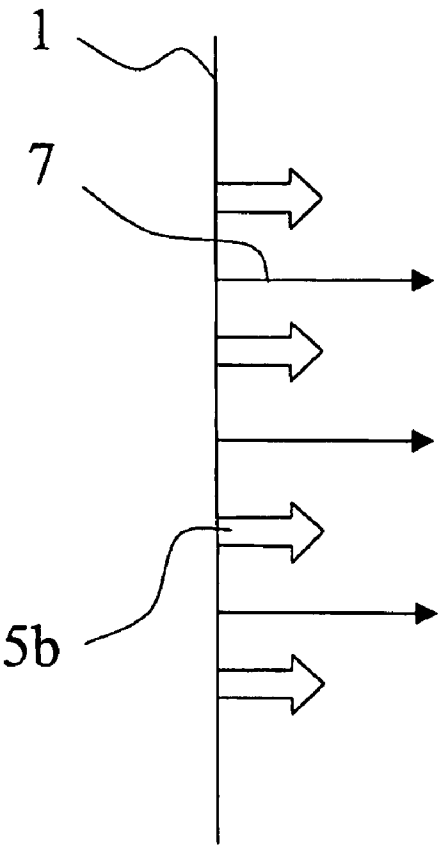
Figure 8:
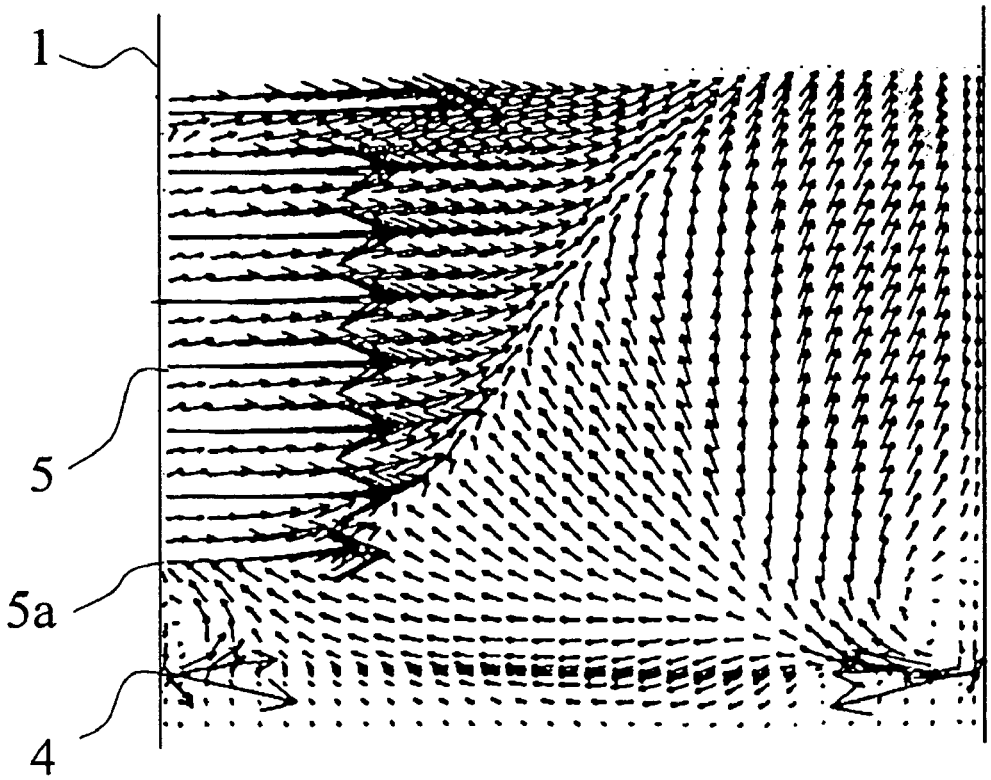
Figure 4:
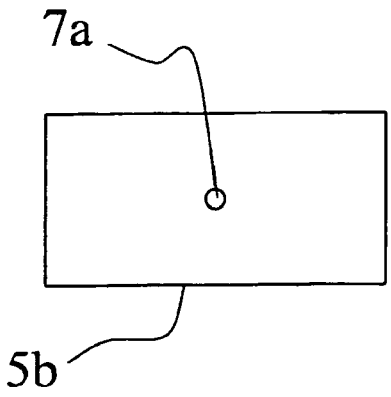
Figure 5:
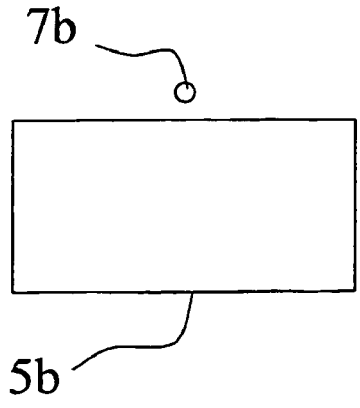
Figure 7:
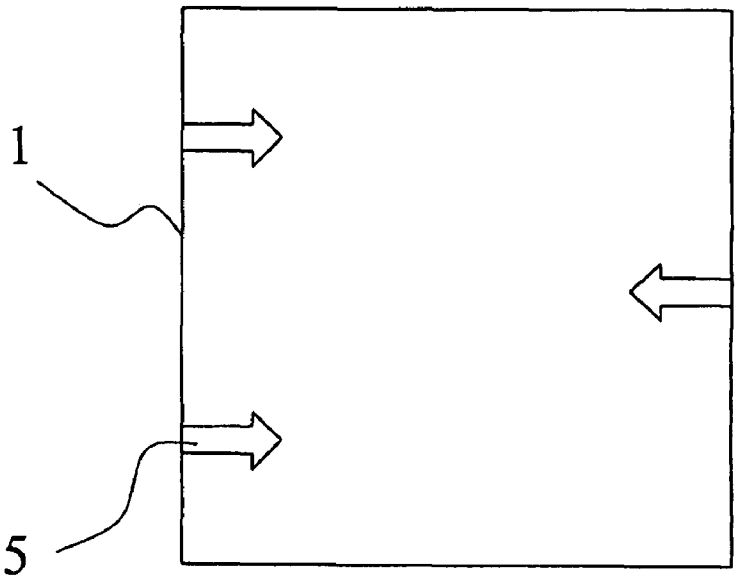
Figure 6:
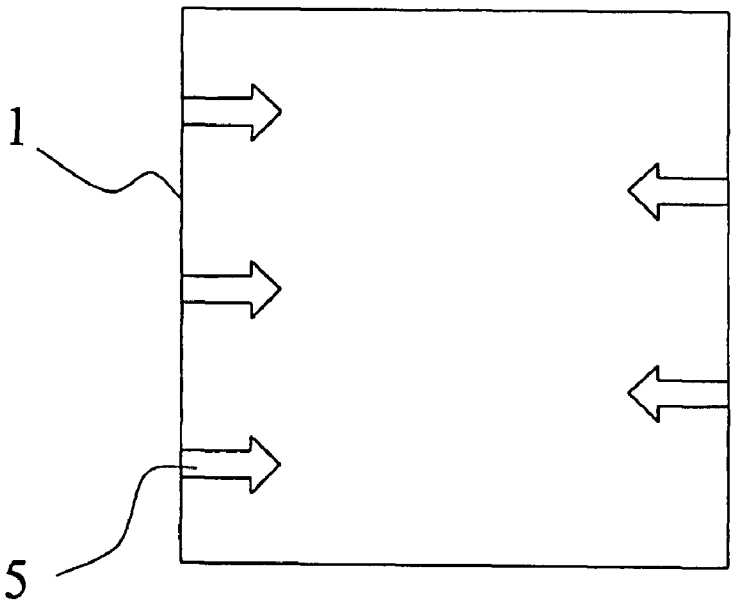

In the following, the invention will be described hereinafter in detail with reference to an embodiment example and the attached drawings, wherein FIG. 1 presents a vertical cross-section of a recovery boiler according to the invention in diagrammatic side view, FIG. 2 presents a detail of a wall of the furnace of the recovery boiler according to the invention in diagrammatic side view, FIG. 3 presents a detail of a wall of the furnace of the recovery boiler according to an embodiment of the invention in diagrammatic side view, FIG. 4 illustrates a manner of placement of a high pressure nozzle according to the invention in connection with a combustion air port in front view, FIG. 5 illustrates another manner of placement of a high pressure nozzle according to the invention in connection with a combustion air port in front view, FIG. 6 presents a diagrammatic top view of a soda recovery boiler according to the invention in transverse cross-section taken at the level of the combustion air ports, FIG. 7 presents a diagrammatic top view of a soda recovery boiler according to the invention in transverse cross-section taken at the level of the combustion air ports, FIG. 8 presents a computer simulation of the flow field in the lower part of the recovery boiler in side view.

FIG. 1 represents a solution according to the invention, showing a soda recovery boiler in a simplified side view. Placed in the lower part of the recovery boiler is a furnace, which comprises at least a bottom and side walls and which often has a rectangular shape formed by four substantially vertical walls. The principal fuel of the combustion process is black liquor, which is sprayed into the furnace in the form of small drops via spray nozzles 6 mounted on the furnace walls, so that a so-called beehive 2 is formed on the bottom of the furnace during the combustion process. The beehive consists of partially dried and partially burned black liquor, and the chemicals contained in it melt in the process and flow out via a chute 3 leading e.g. into a solvent provided for this purpose. The combustion air is supplied into the process through primary ports 4 in the lower part of the furnace, disposed e.g. at even distances on each wall of the furnace. Disposed above the primary ports is a so-called secondary register, which is provided with combustion air ports 5 having a substantially large cross-sectional area and low pressure for the supply of combustion air into the process. To ensure that the air blasted into the furnace will produce a flow field as smooth and good as possible, the air is blown into the furnace so that it will be distributed in the furnace as uniformly as possible and penetrate horizontally through a sufficient distance.

Placed above the secondary register in the walls of furnace 1 are the above-mentioned black liquor spray nozzles 6, through which the black liquor is sprayed in the form of drops into the furnace. Above the spray nozzles region which in prior-art solutions is called tertiary register. In the lower part of this region, combustion air is not necessarily needed for the combustion process, but energy is still needed for maintaining an optimal flow field. Placed at required points in the tertiary register are again low-pressure combustion air ports 5*b* of large cross-sectional area for the supply of combustion air into the process, but substantially small-diameter high-pressure jets 7 are provided at points where no oxygen is needed, these jets being also referred to as jets supplying energy into the flow field. Although ports consisting of the high-pressure nozzles 7 have a small cross-sectional area—the smallest port sizes being typically below 5 $^{cm2}$, i.e. over a hundred times smaller than the cross-sectional area of the combustion air ports, which may be as large as 750 $cm^2$—the can produce even more kinetic energy for flow field control than large air ports. The pressure in the high-pressure nozzles 7 is preferably at least twice as high as that in the combustion air ports, i.e. preferably over 100 mbar. In practice, it is possible to use very high pressures, which are readily available. An efficient pressure range that is easy to control is e.g. between 200–600 mbar. In addition, higher pressures available in different plants may be used. If needed, higher pressures, e.g. pressures of 4–6 bar in plants are very effective. The flow rate achievable by pressure is practically only limited by sound velocity, but even this limitation can be overcome by using special nozzles called Laval nozzles. In this way, it is possible to use supersonic flow velocities, in which case the required energy can be produced using very small nozzles and a penetration sufficient for flow field control is obtained. In many plants, a suitable pressure can also be obtained from the back-pressure steam produced as a surplus product, which typically has a pressure of about 4 bar. In this case, the pressure medium used is steam, which can serve as a source of kinetic energy just as well as high-pressure air. The idea is to create a high flow velocity through a small-diameter nozzle, achieved by using a pressure substantially higher than the pressures used at present, and thus to produce the kinetic energy needed for the control of the flow field in the boiler.

FIGS. 2 and 3 present different ways of disposing the high-pressure nozzles with respect to the combustion air ports. According to FIG. 2, the high-pressure nozzles 7 and the combustion air ports 5*b* are placed alternately one above the other. This arrangement works in a certain area in the furnace, but not necessarily in all areas and all load situations. Correspondingly, FIG. 3 illustrates special situations where the nozzles may be arranged alternately or so that a high-pressure nozzle 7*a* is disposed inside a combustion air port. Similarly, a high-pressure nozzle 7*b* may be disposed in the immediate vicinity of a combustion air port, e.g. just outside the port.

FIGS. 4 and 5 present different ways of disposing the high-pressure nozzles with respect to the combustion air ports as seen from the front side of the ports. In FIG. 4, a high-pressure nozzle 7 is positioned inside a combustion air port 5*b* symmetrically at the center of the port. Correspondingly, in FIG. 5 a high-pressure nozzle 7*b* is positioned immediately above of a combustion air port 5*b* symmetrically at the center of the port. A high-pressure jet placed close to a combustion air port creates a suction that also effectively draws combustion air with it into the process.

FIGS. 6 and 7 illustrate the disposition of combustion air ports 5 and 5*b* relative to each other at one level as seen from above the boiler. A large-scale solution as presented in FIG. 6 may comprise five combustion air ports at the same horizontal level, three ports being arranged on one wall and two on the opposite wall. The ports are arranged on the walls in an intermeshed fashion such that the combustion air jets blown from the ports will intermesh as well as possible without colliding with each other. FIG. 7 presents a corresponding but cheaper solution intended for a smaller boiler. In this case, one of the walls is provided with two combustion air ports 5 or 5*b* and the opposite wall with only one combustion air port at the same level.

The disposition of the high-pressure jets 7 relative to each other on the walls of the furnace 1 is mainly implemented in the same way as the disposition of the combustion air ports according to FIGS. 6 and 7. Accordingly, the high-pressure nozzles are preferably placed in the same vertical rows as the combustion air ports.

For a good process result, it is advantageous to have at each horizontal plane a symmetrical arrangement as well balanced as possible. It is very important that the symmetry of the flow field, especially the right-left symmetry be in a good state before the combustion gases leave the furnace 1. This is possible when the kinetic energy of all the jets at each level is always of about the same order. If the kinetic energy of one of the jets at a given level exceeds that of the others at the same level e.g. by one order of magnitude, i.e. has an energy at least ten times greater than that of the other jets at the same level, then the flow field may be distorted detrimetally.

The symmetry must be in good order at the latest below the so-called boiler spout 8 before the combustion gases reach the superheater. Therefore, it is beneficial to have at least one combustion air port above the topmost high-pressure nozzle. In this context, symmetry refers to flow field symmetry regarding temperatures, velocities and concentrations.

FIG. 8 presents a computer animation of the flow field in the lower part of the furnace. The figure is a vertical cross-section taken at the center of the furnace at the level of the middle row of combustion air ports 5. The flows are depicted as arrows pointing in the flow direction, the length of the arrow representing the flow velocity. It can be seen from the figure that the bottommost combustion air jet 5*a* can not get by itself very far towards the central part of the furnace. The next jet above the bottommost one can already reach a little farther, being assisted by the first jet, the third one reaches still farther, and thus the flow field develops gradually and goes finally completely through, the result being a complete penetration. With this arrangement, the flow field is sufficiently well controlled. If insufficient energy is supplied into the flow field, then the field will decay and control will be lost. For this reason, the flow field must be continuously supplied with kinetic energy either in the form of combustion air or in the form of high-pressure jets. For a flow field capable of efficient mixing, large numbers of small, sharp vortices are needed, which can only be produced by a great internal friction. Great friction again requires plenty of kinetic energy, which has to be supplied into the furnace in the form of powerful gas jets.

It is obvious to the person skilled in the art that the invention is not limited to the example described above, but that it may be varied within the scope of the claims presented below. Thus, for example, the placement of the high-pressure jets can be varied by disposing many high-pressure jets 7 one above the other if the furnace contains a relatively large region where no combustion air is needed. Similarly, a saving will be achieved if the combustion air ports and high-pressure jets can be disposed in an alternate arrangement in the vertical direction where this is possible. Likewise, instead of air or steam, the high-pressure jets can be implemented using other pressure mediums. In addition, an advantageous arrangement is one where the combustion air ports 5, 5*b* and high-pressure jets 7 above the primary ports 4 are disposed in substantially vertical rows, of which there may be either only one or alternatively two or more parallel rows on the same wall. The pressure of the high-pressure jets 7 may also be any pressure available. A suitable pressure range is e.g. between 100 mbar–6 bar, within which range any pressure can be used.

The invention claimed is:

1. System for controlling the flow field in a soda recovery boiler, said soda recovery boiler comprising at least a furnace (1), primary air ports (4) in the lower part of the furnace, combustion air ports (5) disposed above these, black liquor spray nozzles (6) placed similarly above these and combustion air ports (5*b*) above the black liquor spray nozzles (6), characterized in that, in addition to the combustion air ports (5, 5*b*) disposed above and below the black liquor spray nozzles (6), the soda recovery boiler is provided with substantially thin jets (7, 7*a*, 7*b*) supplying energy into the flow field and having a jet pressure in the nozzle equal to at least 100 mbar to 6 bar.

2. System according to claim 1 for controlling the flow field in a soda recovery boiler characterized in that the high-pressure jets (7, 7*a*, 7*b*) are disposed substantially in the same vertical rows with the combustion air ports (5, 5*a*, 5*b*), and that the cross-sectional area of the nozzles for the jets (7, 7*a*, 7*b*) is substantially small as compared to the cross-sectional area of the combustion air ports (5, 5*a*, 5*b*).

3. System according to claim 1 for controlling the flow field in a soda recovery boiler, characterized in that the pressure of the jets (7, 7*a*, 7*b*) supplying energy into the flow field is in a range between 200 mbar–6 bar.

4. System according to claim 1 for controlling the flow field in a soda recovery boiler, characterized in that the jets (7, 7*a*, 7*b*) supplying energy into the flow field are disposed above the black liquor spray nozzles (6) and together with the combustion air ports (b) above black liquor spray nozzles (6) in such manner that, in regions where energy but no oxygen for combustion is needed in the flow field, a high-pressure jet (7) is provided to supply energy into the flow field.

5. System according to claim 1 for controlling the flow field in a soda recovery boiler, characterized in that, in at least a part of the wall of the furnace (1), the jets (7, 7*a*, 7*b*)

supplying energy into the flow field are disposed in an alternate arrangement with the combustion air ports (5*b*) in the vertical direction.

6. System according to claim 1 for controlling the flow field in a soda recovery boiler, characterized in that the jets (7*a*) supplying energy into the flow field are placed inside the combustion air ports (5*b*) where necessary.

7. System according to claim 1 for controlling the flow field in a soda recovery boiler, characterized in that, where necessary, the jets (7*b*) supplying energy into the flow field are placed in the immediate vicinity of the combustion air ports (5*b*), outside the combustion air port (5*b*).

8. System according to claim 1 for controlling the flow field in a soda recovery boiler, characterized in that it comprises at least one combustion air port (5*b*) that is disposed above the topmost jet (7, 7*a*, 7*b*) supplying energy into the flow field and has a pressure lower than that of said jet (7, 7*a*, 7*b*).

9. System according to claim 1 for controlling the flow field in a soda recovery boiler, characterized in that the velocity of the high-pressure jets (7, 7*a*, 7*b*) at the end of the nozzle is higher than sonic velocity.

10. System according to claim 1 for controlling the flow field in a soda recovery boiler, characterized in that the pressure of the jets (7, 7*a*, 7*b*) supplying energy into the flow field is a range between 400 mbar–4 bar.

* * * * *